US011071923B2

(12) United States Patent
Paul

(10) Patent No.: US 11,071,923 B2
(45) Date of Patent: Jul. 27, 2021

(54) TOY WITH MULTIPLE FACE EXPRESSIONS

(71) Applicant: Joanna Paul, Highlands Ranch, CO (US)

(72) Inventor: Joanna Paul, Highlands Ranch, CO (US)

(73) Assignee: WHATSITSFACE, LLC, Highlands Ranch, CO (US)

( * ) Notice: Subject to any disclaimer, the term of this patent is extended or adjusted under 35 U.S.C. 154(b) by 0 days.

(21) Appl. No.: 15/992,868

(22) Filed: May 30, 2018

(65) Prior Publication Data

US 2018/0345158 A1 Dec. 6, 2018

Related U.S. Application Data

(60) Provisional application No. 62/512,427, filed on May 30, 2017.

(51) Int. Cl.
*A63H 3/36* (2006.01)
*A63H 3/12* (2006.01)

(52) U.S. Cl.
CPC ..... *A63H 3/365* (2013.01); *A63H 3/12* (2013.01)

(58) Field of Classification Search
CPC ..... A63H 3/12; A63H 3/365; A63H 3/00
See application file for complete search history.

(56) References Cited

U.S. PATENT DOCUMENTS 846,925 A * 3/1907 Kramer ..... A63G 27/02 472/30
1,049,886 A * 1/1913 Hanson ..... G09F 11/02 40/497

(Continued)

FOREIGN PATENT DOCUMENTS

CA 2295384 A1 7/2001
CN 86106295 A 3/1988

(Continued)

OTHER PUBLICATIONS

Vintage Baby Eskimo Doll Changing 3 Face Head Mood Doll Happy Sad Angry, http://www.etsy.com/listing/206049945/vintage-baby-eskimo-doll-changing-3-face, accessed Oct. 28, 2016.

(Continued)

*Primary Examiner* — Melba Bumgarner
*Assistant Examiner* — Amir A Klayman
(74) *Attorney, Agent, or Firm* — Venable LLP; Keith G. Haddaway; Miguel A. Lopez

(57) ABSTRACT

The present application relates to a device for displaying a panel having an outer structure having a display opening; an inner member rotatably mounted within the outer structure; and a plurality of panels rotatably mounted to the inner member, each of the plurality of panels including a first side and an opposite second side. The inner member is rotatable about a first axis with respect to the outer structure to move one of the plurality of panels into registry with the display opening; and each of the plurality of panels is rotatable about a second axis with respect to the inner member to display the first side or the second side through the display opening in the outer structure.

10 Claims, 15 Drawing Sheets

(56) References Cited

U.S. PATENT DOCUMENTS 1,134,908 A * 4/1915 Romsos ..... A47F 3/10 312/135
1,618,710 A 2/1921 Hose
1,387,224 A * 8/1921 Ahler ..... A63H 3/12 446/321
1,496,406 A * 6/1924 Bertsch ..... A63H 3/365 446/341
1,610,724 A * 12/1926 Wilson ..... A63H 3/12 446/321
1,615,401 A * 1/1927 Payne ..... A63H 3/12 446/321
1,762,374 A * 6/1930 Yancey ..... A63H 3/365 434/155
1,791,616 A * 2/1931 Duclos ..... G09F 7/22 40/497
1,821,243 A * 9/1931 Springer ..... A63H 3/365 446/341
2,194,238 A * 3/1940 Weaver ..... A47F 5/025 160/232
2,220,189 A * 11/1940 Wolters ..... B42F 17/28 40/379
2,285,472 A * 6/1942 Tenenbaum ..... A63H 3/14 446/375
2,584,798 A 2/1952 Goerditz
2,662,339 A * 12/1953 Paul ..... A63H 3/12 40/506
2,669,802 A 2/1954 Oliver
2,670,568 A * 3/1954 Walss ..... A63H 3/40 446/303
2,720,053 A 10/1955 Knott
2,935,814 A * 5/1960 Freeze ..... A63H 33/22 273/155
3,195,736 A * 7/1965 Bomar, Jr. ..... A47F 5/05 211/163
3,498,603 A * 3/1970 Lakin ..... A63H 13/20 472/12
3,538,638 A * 11/1970 Glass ..... G11B 33/06 446/302
3,585,746 A * 6/1971 Sterler ..... G09F 11/04 40/475
3,596,380 A * 8/1971 Williams ..... A44C 17/0258 273/155
3,679,066 A * 7/1972 Leffeld ..... A47F 5/01 211/163
3,734,301 A * 5/1973 Rastocny ..... A47F 5/05 211/205
3,738,055 A * 6/1973 Marble ..... A63H 3/365 446/341
3,830,012 A * 8/1974 Franke ..... A63H 3/16 446/321
3,924,749 A * 12/1975 Weston ..... A47F 5/04 211/4
4,030,239 A * 6/1977 White ..... A63H 3/12 446/321
4,246,723 A * 1/1981 Winters ..... A63H 3/40 223/66
4,373,729 A * 2/1983 Hanson ..... A63F 9/083 273/153 S
4,381,620 A * 5/1983 Panzarella ..... A63H 33/00 446/177
4,451,038 A * 5/1984 Nagy ..... A63F 7/042 273/110
4,610,638 A * 9/1986 Iwao ..... A63H 15/00 446/241
4,645,471 A * 2/1987 Herring ..... A63H 33/00 446/258
4,655,723 A * 4/1987 Marason, Jr. ..... A63H 33/00 411/385
4,805,331 A * 2/1989 Boggess ..... G09F 7/22 211/59.2
4,910,898 A * 3/1990 Hector ..... G09F 7/22 40/479
5,215,493 A 6/1993 Zgrodek et al.
5,280,840 A * 1/1994 Terpening ..... A47F 5/02 211/165
5,309,657 A * 5/1994 Spencer ..... A47F 5/02 40/473
5,405,266 A * 4/1995 Frank ..... G09B 19/00 434/236
5,893,789 A * 4/1999 Wu ..... A63H 33/26 40/426
6,146,721 A 11/2000 Freynet
6,558,221 B1 * 5/2003 Yang ..... A63H 3/365 446/100
6,758,717 B1 * 7/2004 Park ..... A63H 3/365 446/321
6,793,553 B2 * 9/2004 Willett ..... A63H 3/365 446/301
6,893,317 B1 * 5/2005 Vlodek ..... A63H 33/22 40/377
6,904,776 B1 6/2005 Lin
6,905,390 B2 * 6/2005 Fukui ..... B25J 19/00 446/337
6,962,517 B2 11/2005 Murray
6,971,332 B2 * 12/2005 Woltmann ..... A01K 15/025 119/467
7,185,769 B2 * 3/2007 Glass ..... A47F 5/02 211/163
7,637,043 B2 * 12/2009 Brown, Jr. ..... G09F 11/02 40/475
7,931,520 B2 * 4/2011 Bryce ..... A63H 33/007 446/273
8,123,224 B2 * 2/2012 DeRuyter ..... A63F 9/0413 273/146
8,272,519 B1 * 9/2012 Rekhels ..... A47F 5/02 211/163
8,662,955 B1 * 3/2014 Fai ..... A63H 13/02 446/337
8,998,672 B2 * 4/2015 Lin ..... A63H 3/20 446/330
9,421,452 B2 * 8/2016 Carlow ..... A63F 9/0842
9,474,981 B1 10/2016 Forti
2001/0004577 A1 6/2001 Lewis
2002/0019193 A1 * 2/2002 Maggiore ..... A63H 3/48 446/337
2002/0067038 A1 * 6/2002 Tran ..... B65D 5/425 281/29
2003/0070459 A1 4/2003 Yu et al.
2004/0093777 A1 5/2004 Park
2006/0081548 A1 * 4/2006 Babbino ..... A47F 7/021 211/85.1
2006/0270312 A1 * 11/2006 Maddocks ..... A63H 3/28 446/337
2006/0275562 A1 * 12/2006 Kleinsasser ..... B44C 3/082 428/11
2009/0308919 A1 12/2009 Sheldon et al.
2012/0142250 A1 * 6/2012 Andersen ..... A63H 13/005 446/321
2013/0023183 A1 * 1/2013 Zheng ..... A63H 3/12 446/394
2019/0282912 A1 * 9/2019 Bella Martorell ..... A63H 3/12

FOREIGN PATENT DOCUMENTS

CN 2768865 Y 4/2006
CN 102631782 A 8/2012
CN 202438149 9/2012
CN 202666388 U 1/2013
CN 202892891 U 4/2013
GB 930940 A * 7/1963 ..... A63H 3/12
GB 930940 A 7/1963
NL 1034526 A1 4/2009
WO WO 2004/089489 10/2004

OTHER PUBLICATIONS

Vintage Rubber 3 Face Baby Doll Spin Head 8" Hong Kong Happy Crying Sleeping, http://www.ebay.com/itm/Vintage-Rubber-3-Face-

(56) References Cited

OTHER PUBLICATIONS

Baby-Doll-Spin-Head-8-Hong-Kong-Happy-Crying-Sleeping/371698731814?_trksid=p2047675.c100005.m1851&_trkparms=aid%3D222007%26algo%3DSIC.MBE%26ao%3D1%26asc%3D39798%26meid%3D0afaf4d18f0e492b9dc365fc64c2fffc%26pid%3D100005%26rk%3D1%26rkt%3D6%26sd%3D152288749934, accessed on Oct 28, 2016.

International Search Report/Written Opinion in related Foreign Application No. PCT/US2018/035164 dated Aug. 24, 2018.

* cited by examiner

TOY WITH MULTIPLE FACE EXPRESSIONS

CROSS-REFERENCE TO RELATED APPLICATIONS

This application claims priority under 35 U.S.C. Section 119 to U.S. Provisional Patent Application No. 62/512,427 filed on May 30, 2017, the entire contents of which are hereby incorporated by reference.

TECHNICAL FIELD

The present application relates generally to a toy, such as a figurine. More specifically, the present application relates to such a toy having a head unit with an outer structure containing rotatable panels inside that provide for the display of multiple faces and/or facial expressions.

BACKGROUND

The vast majority of dolls and action figures available on the market have a body portion and a head portion having a single face displaying a single facial expression. This limits a user from pretending that a doll or action figure can express a different emotion or look during play. It also prevents the possibility of using the doll or action figure to represent multiple subjects.

BRIEF SUMMARY OF THE INVENTION

An embodiment of the invention relates to a device for displaying a panel, having an outer structure having a display opening; an inner member rotatably mounted within the outer structure; and a plurality of panels rotatably mounted to the inner member, each of the plurality of panels including a first side and an opposite second side. The inner member is rotatable about a first axis with respect to the outer structure to move one of the plurality of panels into registry with the display opening; and each of the plurality of panels is rotatable about a second axis with respect to the inner member to display the first side or the second side through the display opening in the outer structure.

Another embodiment of the invention relates to a doll or action figure having a body portion; and the device for displaying a panel above coupled to the body portion, where each of the plurality of panels displays a different face or facial expression.

Another embodiment of the invention relates to a method for displaying a plurality of different faces or facial expressions on a doll or action figure, the method including: rotating an inner member within an outer structure until one of a plurality of panels mounted on the inner member is located in registry with a display opening on the outer structure; and rotating the panel located in registry with the display opening until a first side or a second side of the panel is located in registry with the display opening, the first side and the second side of the panel containing different faces or facial expressions.

DESCRIPTION OF THE FIGURES

Exemplary embodiments of the invention will be now described in greater detail below with reference to the accompanying drawings, in which:

In FIGS. 9A-9C, a front panel of the outer structure is removed to show the inner member and other components;

In FIGS. 11A-11C, a front side of the panel is removed to show the inner components of the panel as the panel is rotated.

DETAILED DESCRIPTION OF THE INVENTION

An embodiment of the invention relates to a device for displaying a panel, having an outer structure having a display opening; an inner member rotatably mounted within the outer structure; and a plurality of panels rotatably mounted to the inner member, each of the plurality of panels including a first side and an opposite second side. The inner member is rotatable about a first axis with respect to the outer structure to move one of the plurality of panels into registry with the display opening; and each of the plurality of panels is rotatable about a second axis with respect to the inner member to display the first side or the second side through the display opening in the outer structure.

An embodiment of the present invention relates to the device for displaying a panel above, where the first side and the second side of each of the plurality of panels has a different face or a facial expression.

An embodiment of the invention relates to a method for displaying a plurality of different faces or facial expressions on a figurine, the method including: rotating an inner member within an outer structure until one of a plurality of panels mounted on the inner member is located in registry with a display opening on the outer structure; and rotating the panel located in registry with the display opening until a first side or a second side of the panel is located in registry with the display opening, the first side and the second side of the panel containing different faces or facial expressions.

Figure 1:
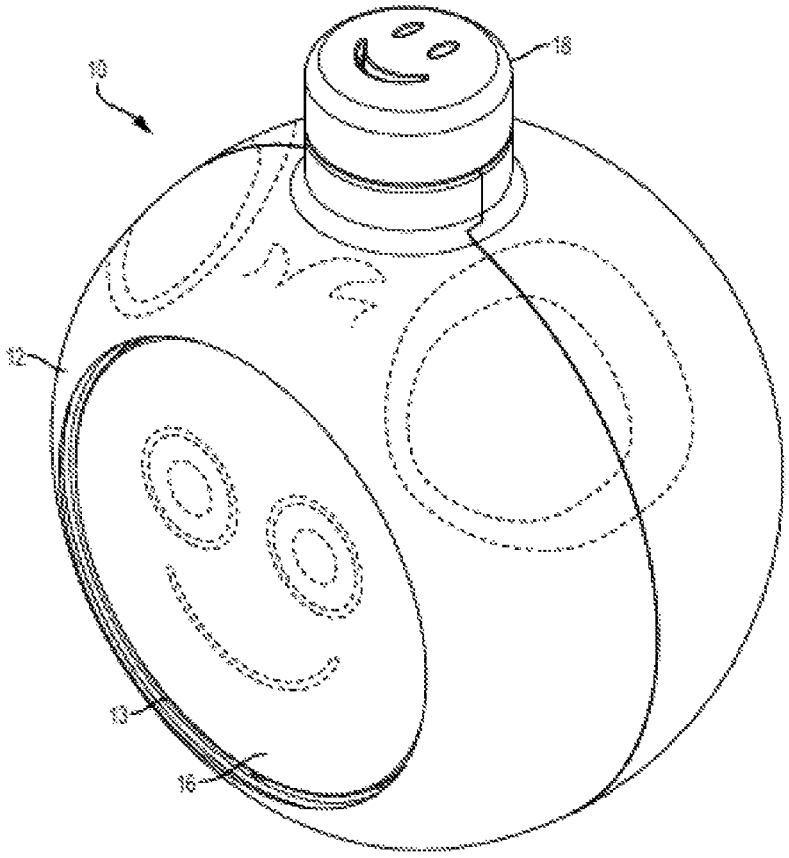
FIG. 1 shows an embodiment of a head unit for a doll or action figure having an outer structure and a rotatable inner member having multiple panels each having a different facial expression according to an embodiment of the invention.
Figure 2:
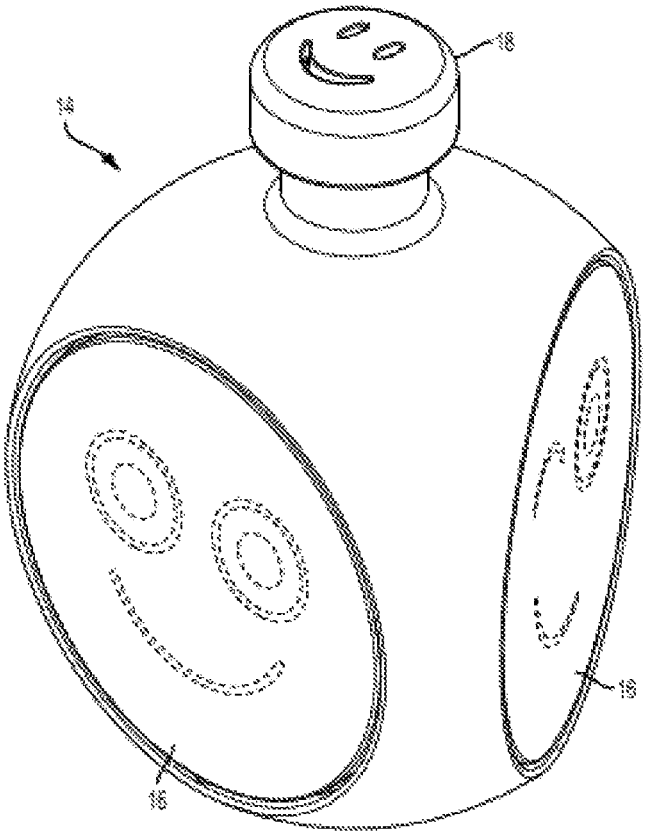
FIG. 2 is a view of the inner member of FIG. 1, showing two of the panels, each having a different facial expression.

FIG. 1 and FIG. 2 show a head unit 10 for a doll or action figure having an outer structure 12 and a rotatable inner member 14 having multiple panels 16 each having a different facial expression according to an embodiment of the invention. The head unit 10 of FIG. 1 and FIG. 2 allows for the display of a single panel 16 at a time as the inner member 14 is rotated by turning the attached shaft and knob 18. The inner member 14 is contained within the outer structure 12. In such an embodiment, the inner member 14 is configured to rotate within the outer structure 12 along a first axis. The inner member 14 has a plurality of panels 16 and a shaft and knob 18 extending from the inner member 14 and protruding through an aperture in the outer structure. The shaft and knob 18 are configured to enable rotation of the inner member 14 within the outer structure 12 along the first axis. A display opening 13 is disposed on the outer structure 12 such that the opening 13 is configured to display at least a portion of one of the plurality of panels 16 at a time. Rotation of the inner member 14 within the outer structure 12 along the first axis enables display of at least a portion of any one of the plurality of panels through the display opening 13. According to an embodiment, a different face or different facial expression can be located on each side of each panel 16, such that no two sides of any of the panels 16 display the same face or facial expression. Alternatively, the same face and facial expression can be repeated such that at least two of the plurality of sides contained across the panels share the same face and facial expression. Accordingly, various combinations and permutations of repeating and non-repeating faces and facial expressions are possible.

Figure 3:
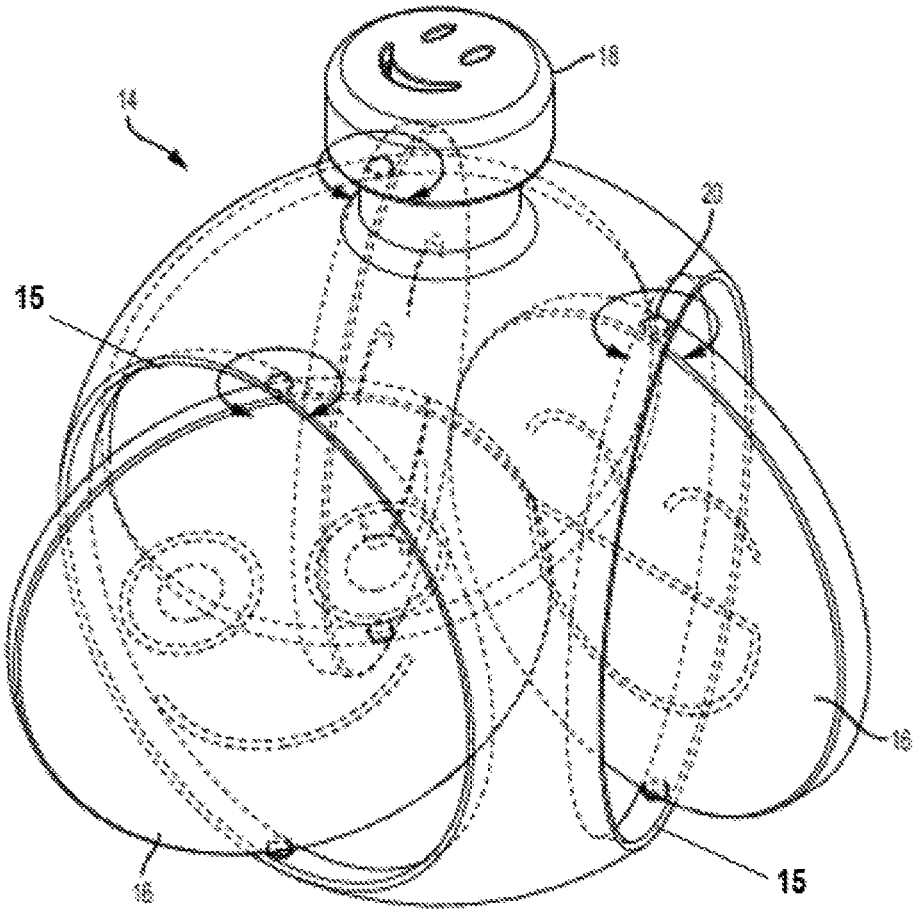
FIG. 3 is a view of the inner member of FIG. 2, showing internal components in broken lines, and showing rotatable panels, each of which has a different facial expression.

FIG. 3 shows a transparent illustration of the inner member described above showing three rotatable panels 16, each of which has a different facial expression. In FIG. 3, each of the three rotatable panels 16 is a two-sided panel having a first side and a second side and is configured to rotate within a corresponding window 15 for each of the three rotatable panels 16 within the inner member 14 along a second axis 20 such that rotation of the two-sided panel 16 allows for display of the first side or the second side through the display opening 13 of the outer structure. In some embodiments, the second axis is parallel to the first axis. In some embodiments, the second axis is not parallel to the first axis.

In some embodiments of the invention, the panels 16 have more than two sides. For example, in some embodiments, the panels have 3, 4, 5, 6 or more sides.

Figure 4:
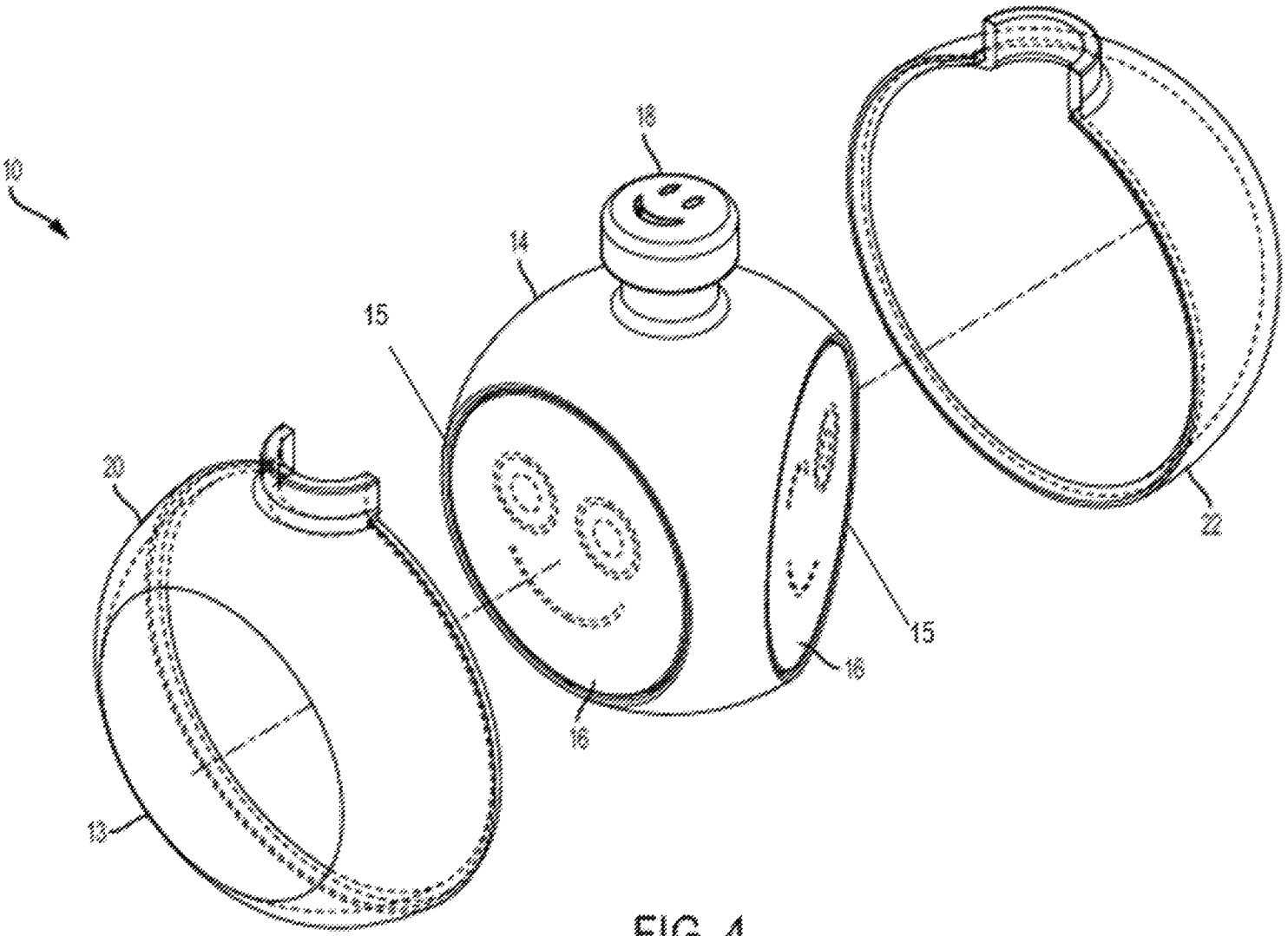
FIG. 4 is an exploded view of the head unit of FIG. 1, showing the position of the inner member relative to two joinable members making up the outer structure.

FIG. 4 is an exploded view of the head unit 10 described above showing the position of the inner member 14 having panels 16 and a shaft 18 relative to two joinable members 20, 22 that make up the outer structure 12. In such an embodiment, the display opening 13 is disposed on one of the joinable members 20 such that one panel 16 of the inner member 14 can be displayed. The two joinable members can also be configured to form an opening through which the shaft and knob 18 of the inner member 14 can extend. In embodiments where the outer structure has more than one member, means for joining the complementary members would be apparent to one of ordinary skill in the art. Non-limiting examples of how the complementary members can be joined include screws, clamps, adhesives, fasteners, etc. In some embodiments, the complementary members can be configured such that they snap or lock into place when engaged. In some embodiments, the complementary members can be reversibly joined. In some embodiments, the complementary members can be permanently joined.

Figure 5:
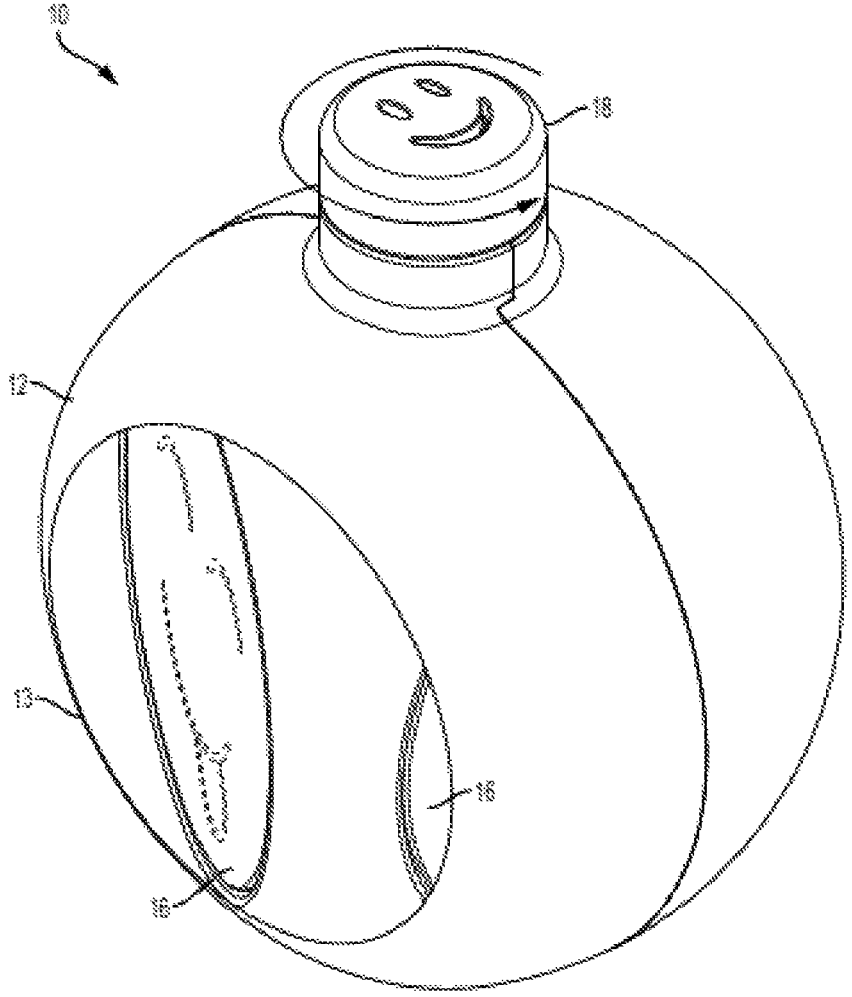
FIG. 5 shows the head unit of FIG. 1 during use as the inner member is being rotated to display a facial expression.

FIG. 5 shows the head unit 10 described above during use as shaft and knob 18 are rotated so that a facial expression on a panel 16 is displayed through the display opening 13 on the outer structure 12.

Figure 6C:
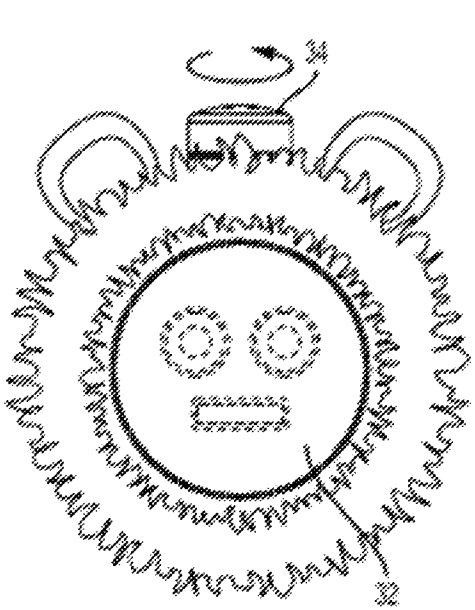
FIGS. 6A, 6B, and 6C are a series of images of the head unit of FIG. 1, adorned with fur, and illustrating rotation of the inner member within the head unit resulting in the display of different panels each displaying a different facial expression.
Figure 6B:
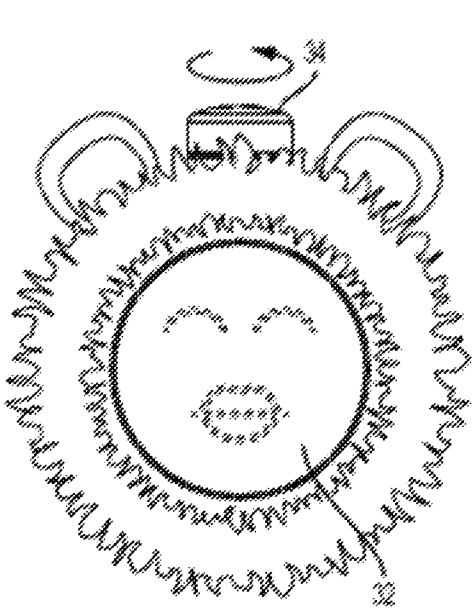
Figure 6A:
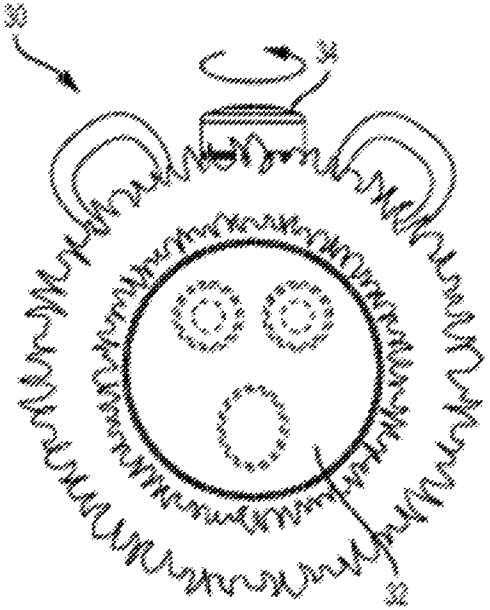

FIGS. 6A, 6B and 6C display rotation of an inner member of a head unit 30 for a plush and furry doll according to an embodiment of the invention. As seen in FIGS. 6A, 6B, and 6C, the head unit 30 allows for the display of different panels 32 each of which has a different face or facial expression. The different panels can be displayed individually by rotating the shaft and knob 34 attached to the inner member. As a user rotates the shaft and knob, a different panel 32 displaying a different face or facial expression can be displayed.

Figure 7A:
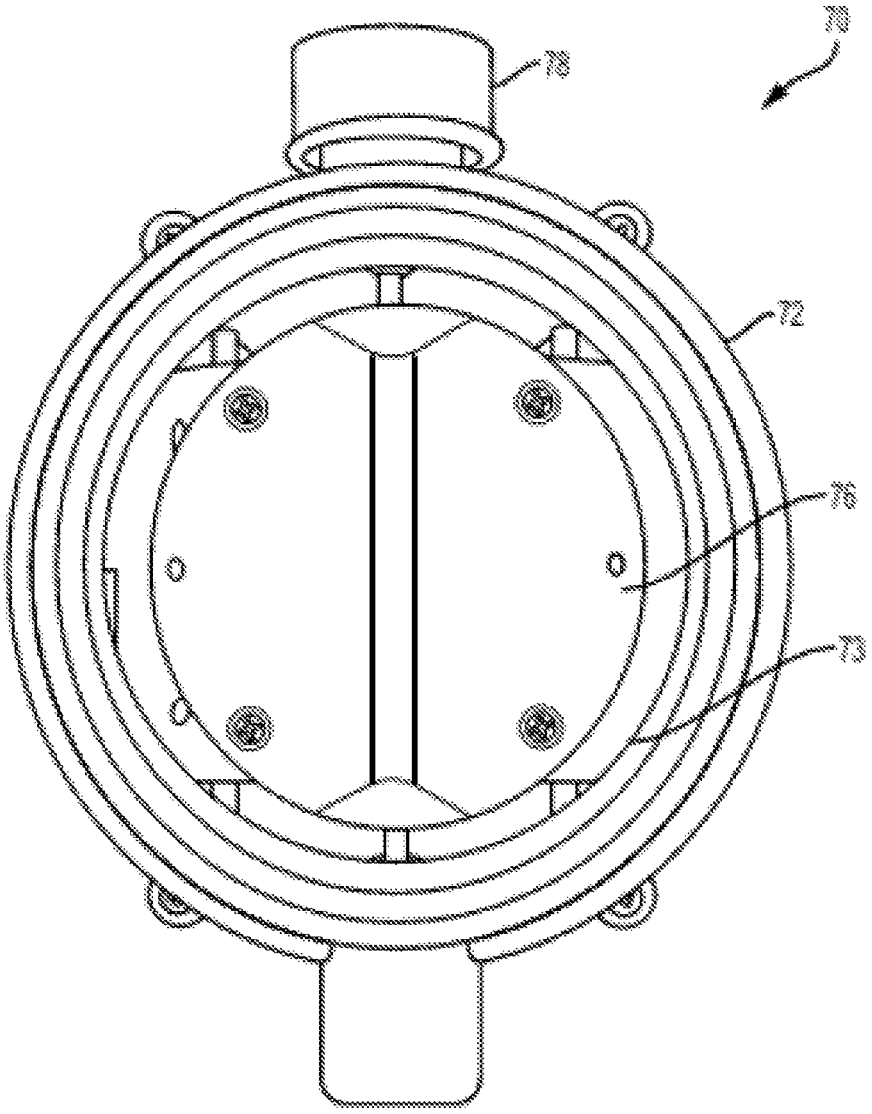
FIG. 7A shows a front view of an embodiment of a device for displaying a panel having an outer structure and a rotatable inner member having multiple panels according to a second embodiment of the invention.
Figure 7B:
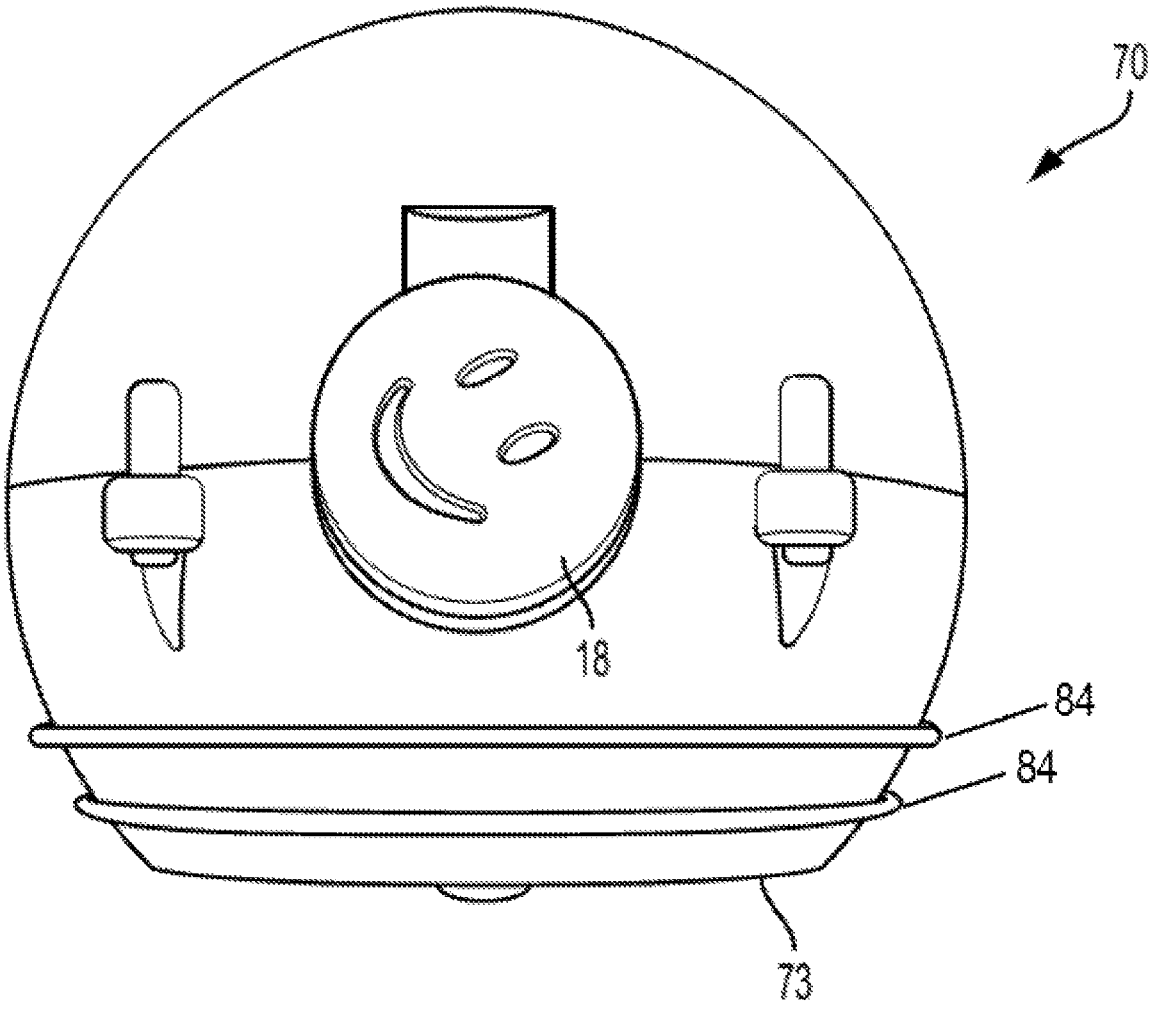
FIG. 7B shows a top view of the device of FIG. 7A.
Figure 7C:
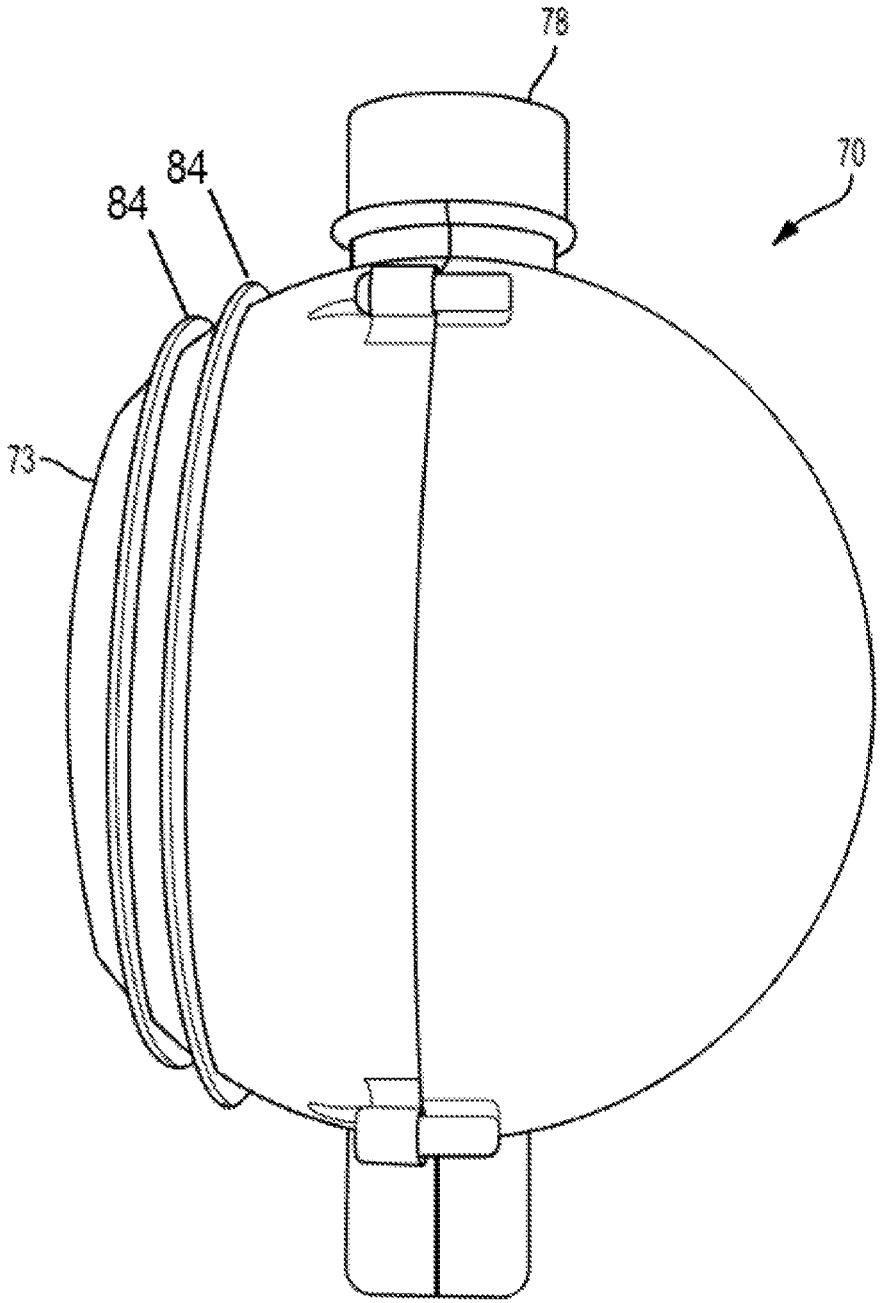
FIG. 7C shows a side view of the device of FIG. 7A.
Figure 7D:
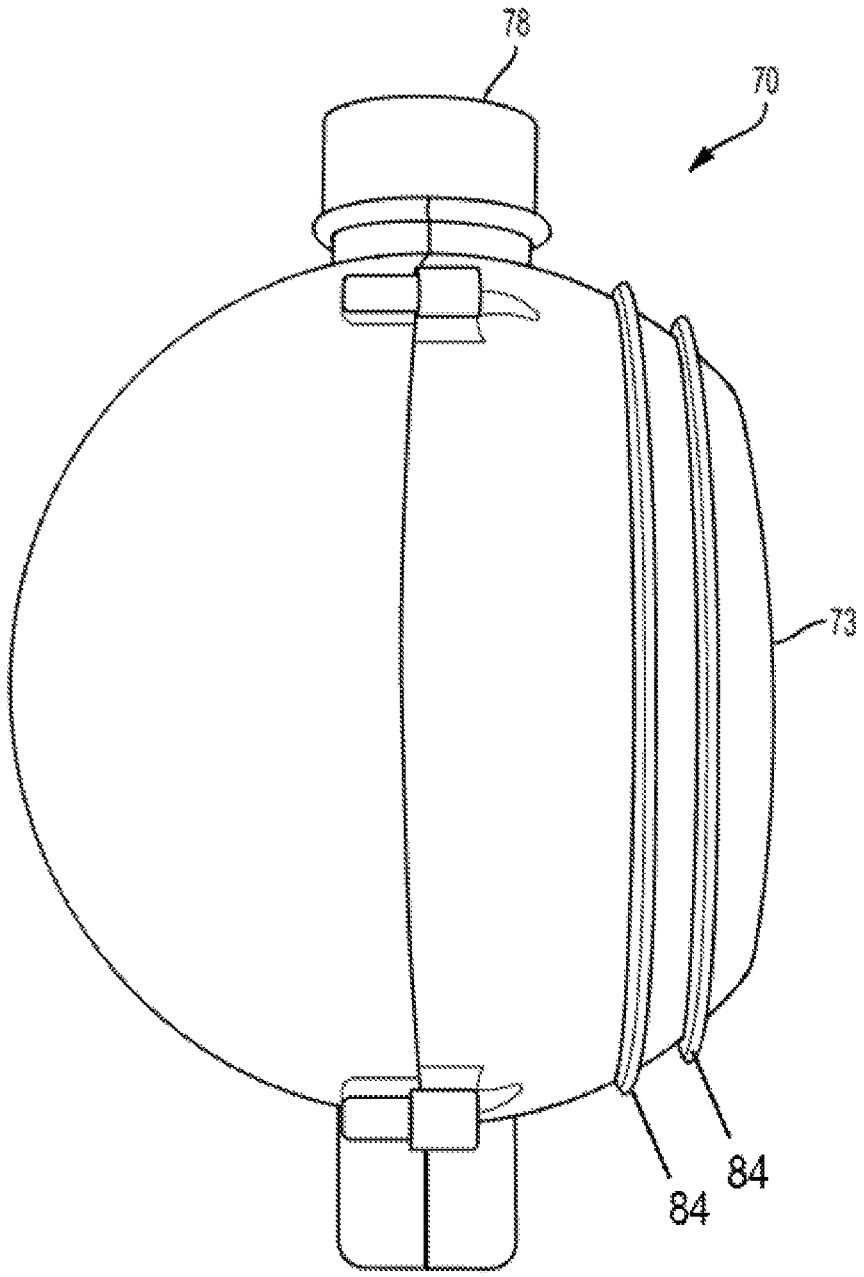
FIG. 7D shows another side view of the device of FIG. 7A.

FIGS. 7A-7D show a head unit 70 for a doll or action figure having an outer structure 72 and a rotatable inner member having multiple panels 76, where each panel can have a different face or facial expression according to an embodiment of the invention. More specifically, FIG. 7A is a front view of the head unit, FIG. 7B is top view of the head unit, and FIGS. 7C and 7D are side views of the head unit. The head unit 70 allows for the display of a single panel 76 at a time as the inner member is rotated by turning the attached shaft and knob 78. The inner member is contained within the outer structure 72. In such an embodiment, the inner member is configured to rotate within the outer structure 72 along a first axis. The inner member 74 has a plurality of panels 76 and a shaft with a knob 78 extending from the inner member and protruding through an aperture in the outer structure. The shaft is configured to enable rotation of the inner member within the outer structure 72 along the first axis. A display opening 73 is disposed on the outer structure 72 such that the display opening 73 is configured to display at least a portion of one of the plurality of panels 76 at a time. Rotation of the inner member within the outer structure 72 along the first axis enables display of at least a portion of any one of the plurality of panels through the display opening 73.

In FIGS. 7A-7D, each of the multiple panels 76 is a two-sided panel having a first side and a second side and is configured to rotate within the inner member 74 along a second axis such that rotation of the two-sided panel 76 allows for display of the first side or the second side through the display opening of the outer structure. In some such embodiments, the second axis is parallel to the first axis. In some such an embodiments, the second axis is not parallel to the first axis.

In FIGS. 7A-7D, the head unit can comprise one or more circular ridges 84 for securing the outer structure 72 to the head of a doll. In such embodiments, fabric from the doll is secured by a cable tie assembly which is secured between two ridges 84.

Figure 8:
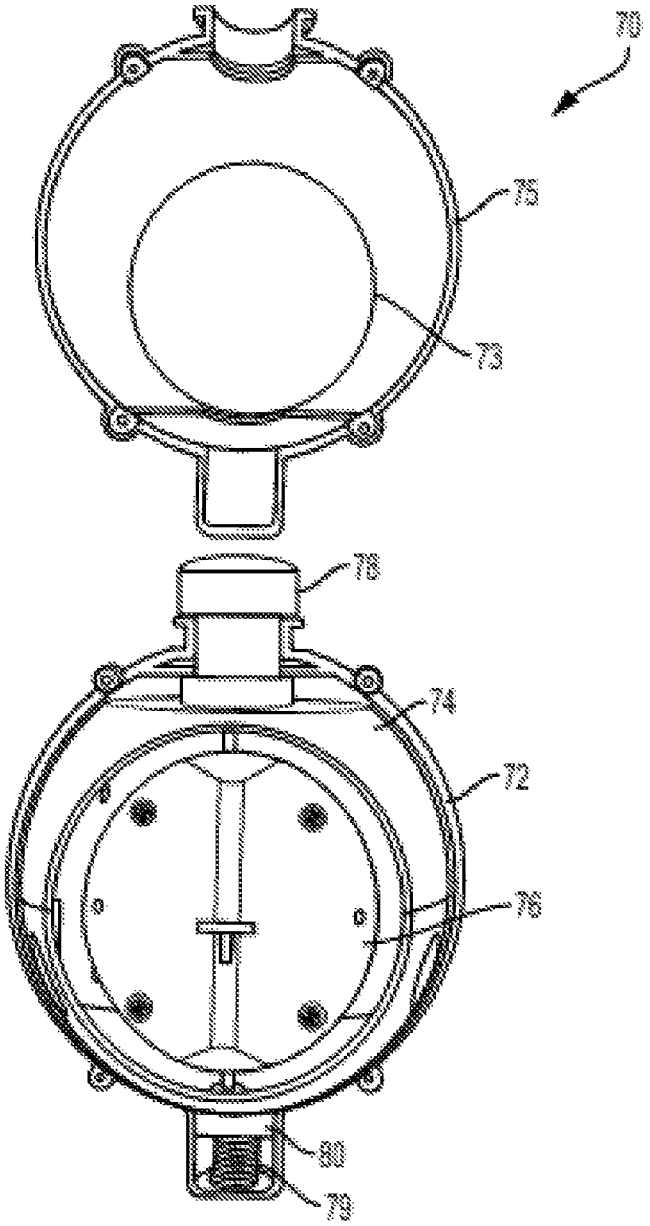
FIG. 8 is an exploded view of the device of FIG. 7A, showing the inner member within the outer structure.
Figure 9C:
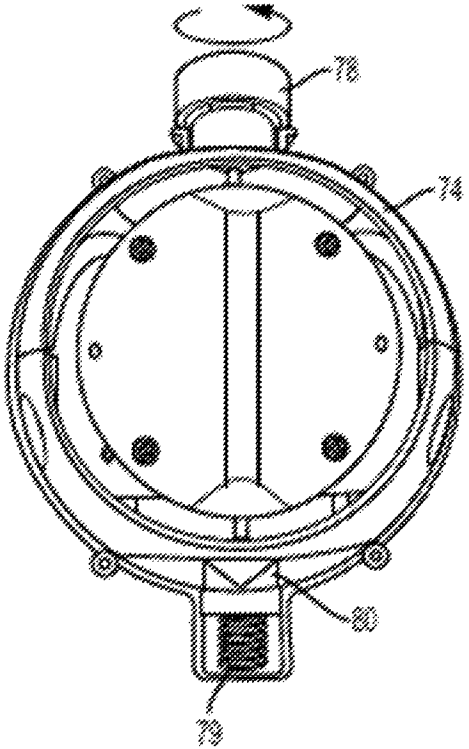
FIGS. 9A, 9B, and 9C are a series of images of the device of FIG. 7A depicting rotation of the inner member within the outer structure.
Figure 9B:
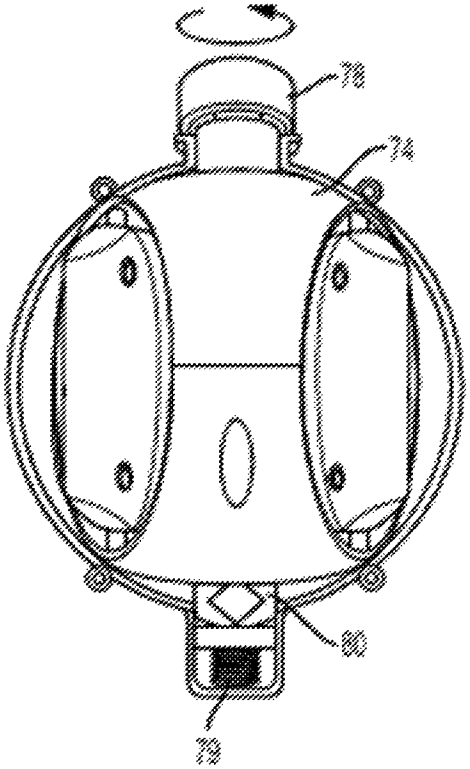
Figure 9A:
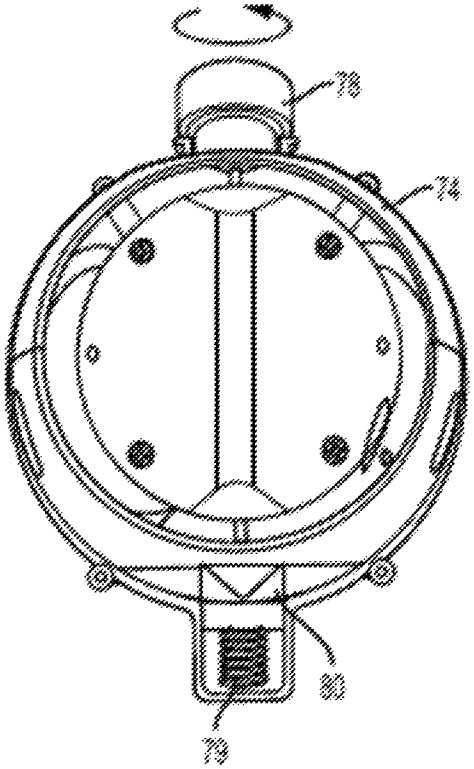

FIG. 8 is an exploded view of the head unit of FIGS. 7A-7D depicting the inner member 74 within the outer structure. FIGS. 9A-9C are a series of images showing the configuration of the inner member 74 as it rotates within the outer structure (left to right, FIGS. 9A-9C). In FIG. 8 and in FIGS. 9A-9C, a front panel from the outer structure 75 is removed to show the inner member and components as the inner member rotates. As explained above, the head unit 70 allows for the display of a single panel 76 at a time as the inner member is rotated by turning the attached shaft 78. The inner member is contained within the outer structure 72. In such an embodiment, the inner member is configured to rotate within the outer structure 72 along a first axis. The inner member 74 has a plurality of panels 76 and a shaft with a knob 78 extending from the inner member and protruding through an aperture in the outer structure. The shaft is configured to enable rotation of the inner member within the outer structure 72 along the first axis. A display opening 73 is disposed on the outer structure 72 such that the display opening 73 is configured to display at least a portion of one of the plurality of panels 76 at a time. Rotation of the inner member within the outer structure 72 along the first axis enables display of at least a portion of any one of the plurality of panels through the display opening 73. Also, each of the multiple panels 76 can be a multi-sided panel (e.g., two-sided) having at least a first side and a second side and configured to rotate within the inner member 74 along a second axis such that rotation of the panel 76 allows for display of the first side or the second side through the second opening of the outer structure.

In the embodiment depicted in FIG. 8, FIGS. 9A-9C, FIG. 10A, and FIG. 10B the head unit comprises a detent system associated with the inner member 74 and the outer structure 72. The detent system is adapted to releasably hold the inner member 74 in place with respect to the outer structure 72 with one of the plurality of panels in registry with the display opening. In some embodiments, the detent system comprises a spring-biased detent system having an elastic member 79 and mating ramped structures 80. The elastic member biases ramped surfaces of the mating ramped structures into engagement with one another. As seen in FIGS. 9A, 9B and 9C, when a user applies a sufficient force to rotate the inner member, the two ramped surfaces slide against one another, FIG. 9B, compressing the elastic member until the ramped structures disengage and permit the inner member to rotate to a different incremental position. At that point, FIG. 9C, the elastic member extends, pushing the ramped surfaces back into engagement and holding the inner member in place until the rotation is applied once again to move the inner member to the next incremental position. A non-limiting example of an elastic member is a spring or elastomer.

In some embodiments, the detent system allows for a 360 degree rotation of the inner member. In some embodiments, the detent system is configured to allow the inner member to rotate in 120 degree increments, however other quantities and sizes of increments are possible.

Figure 10A:
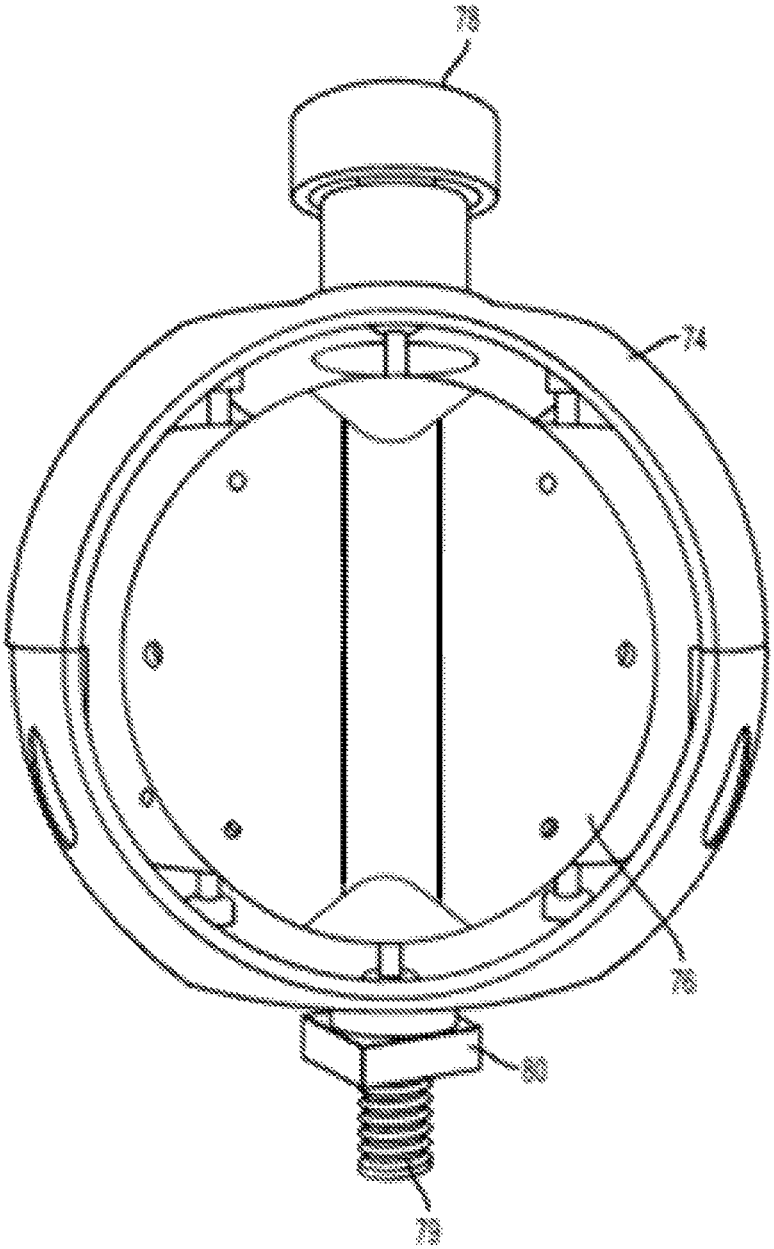
FIG. 10A is a front view of the inner member of FIG. 7A.
Figure 10B:
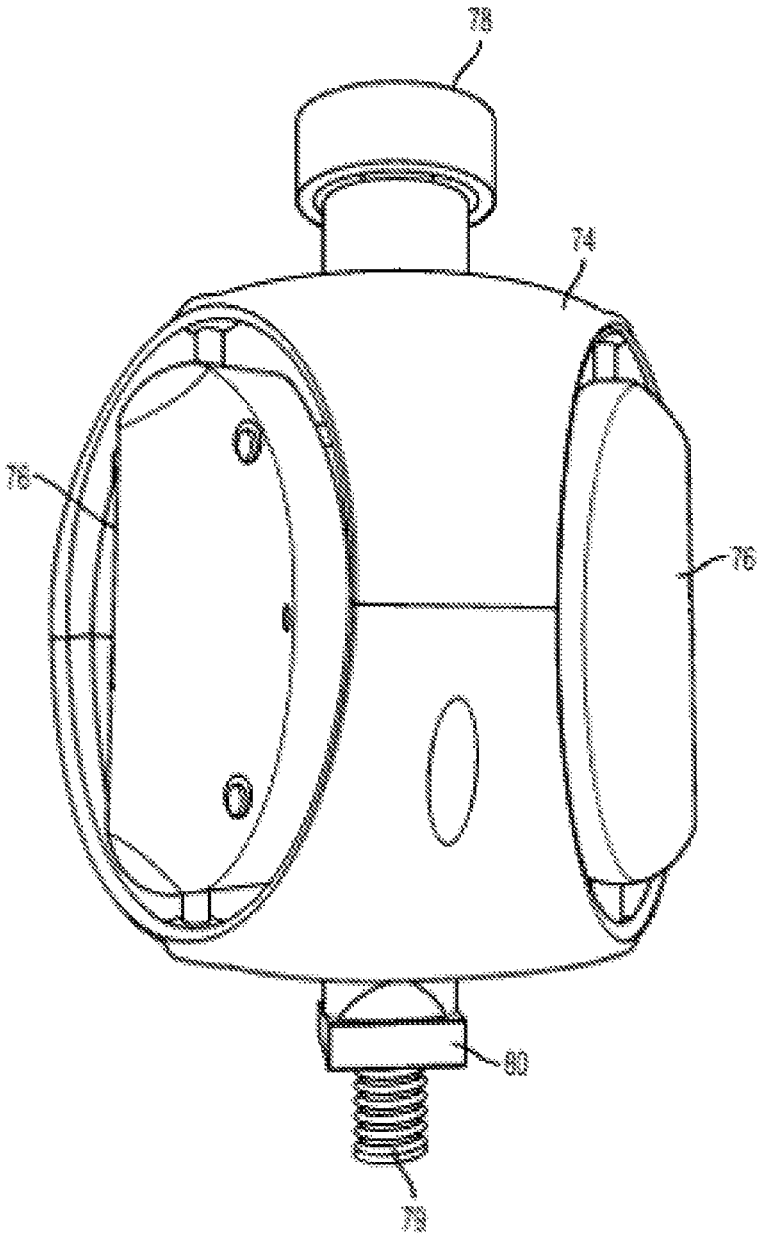
FIG. 10B is a perspective view of the inner member of FIG. 7A.

FIGS. 10A and 10B show views of the inner member 74 and its shaft 78, one panel 76, and detent system having an elastic member 79 and mating ramped structures 80. FIG. 10A is a front view and FIG. 10B is a side view.

Figure 11C:
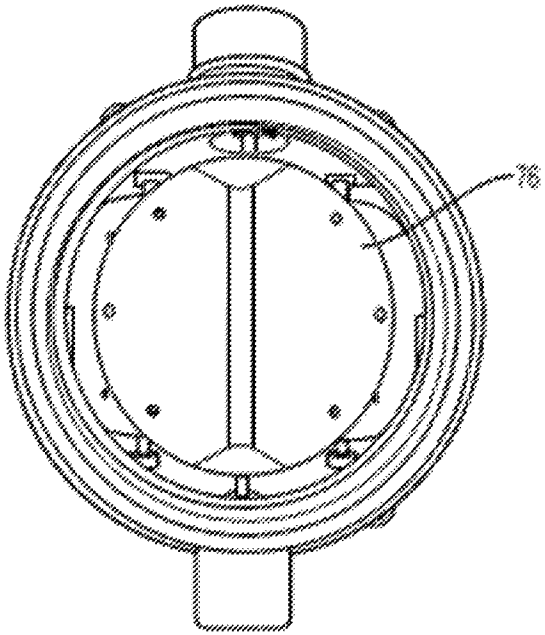
FIGS. 11A, 11B, and 11C are a series of images of the device of FIG. 7A depicting rotation of the panel within the inner member.
Figure 11B:
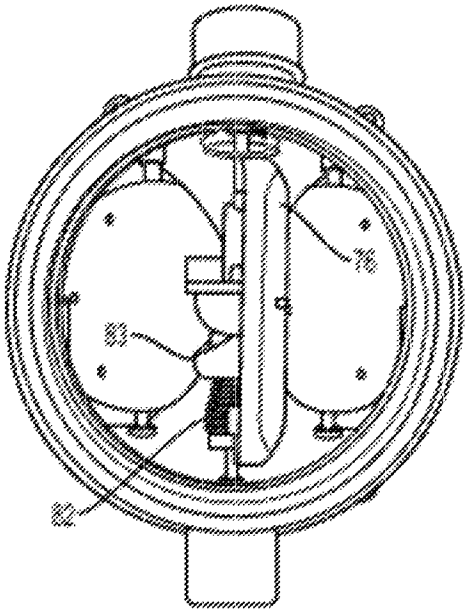
Figure 11A:
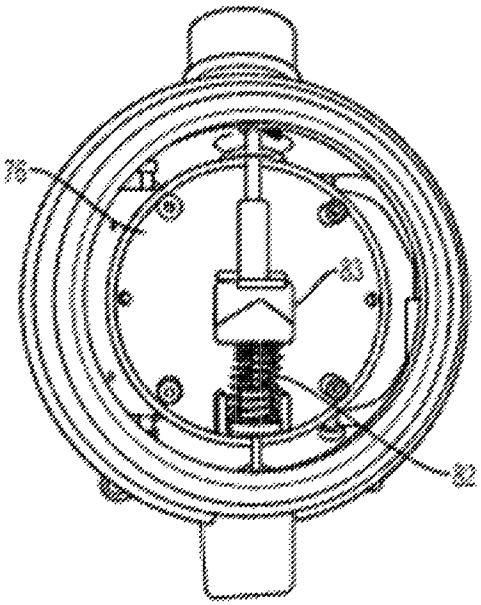

FIGS. 11A-11C are a series of images showing the configuration of a panel 76 as it rotates along the second axis within the inner member (left to right, FIGS. 11A-11C) of the head unit of FIGS. 7A-7D. In FIGS. 11A-11C, a front side of the panel is removed to show inner components as the panel is rotated. In such embodiments, the panels each have a detent system. The detent system is adapted to releasably hold the panel 74 in place while one of the two sides is being displayed. In some embodiments, the detent system comprises a spring-biased detent system having an elastic member 82 and mating ramped structures 83. The elastic member biases ramped surfaces of the mating ramped structures into engagement with one another. As seen in FIGS. 11A, 11B and 11C, when a user applies a sufficient pressure to rotate the panel, the two ramped surfaces slide against one another, FIG. 11B, compressing the elastic member until the ramped structures disengage and permit the panel to rotate to a different incremental position. At that point, FIG. 11C, the elastic member extends, pushing the ramped surfaces back into engagement and holding the panel in place until the pressure is applied once again to move the panel to the next incremental position. A non-limiting example of an elastic member is a spring or elastomer.

In some such embodiments, the detent system allows for the 360 degree rotation of the panel within the inner member. In some such embodiments, the detent system is configured to allow the panel to rotate in 180 degree increments however other quantities and sizes of increments are possible.

In some embodiments according to the invention, the doll or action figure is designed to resemble a subject. As used throughout, the term "subject" can refer to a particular animal or organism, a cartoon character, a public figure, or a fictional character or animal or organism. Accordingly, the head unit can be attached to or incorporated into a plush toy. Alternatively, the head unit can be adorned with fur or other decorations. In some embodiments, the doll or action figure is customizable to resemble a user or avatar.

In some embodiments according to the invention, the plurality of panels of the inner member of the head unit display different facial expressions of a single subject. In such embodiments, a user can rotate between various facial expressions to allow the doll or action figure to project different imaginary expressions and/or emotions during use.

In some embodiments according to the invention, the plurality of panels of the inner member of the head unit display different facial expressions of different subjects. In such embodiments, the presence of different facial expressions from different subjects allows a user to pretend that the doll or action figure represents more than one subject during use.

In some embodiments according to the invention, the head unit is detachable from the body portion.

In some embodiments according to the invention, the inner member has panels having designs, graphics, or structures that are either two dimensional or three dimensional. Regardless, the inner member is configured such that the panels rotate freely such that the various designs, graphics or structures do not obstruct one another.

In some embodiments, the panels are configured to lock or snap into place following a 180 degree rotation in order to prevent the panel from unintentionally rotating during use of the doll or action figure.

In some embodiments, the inner member is configured to lock or snap into place during rotation and following positioning of a desired panel into the display opening of the outer structure in order to prevent the inner member from unintentionally rotating during use of the doll or action figure.

In some embodiments, the outer structure of the head unit is a helmet or a hood.

In some embodiments, the outer structure is decorated with accessories including but not limited to ears, hair or a wig, or a hat. Additional accessories that can be used to decorate the outer structure can be readily envisioned by one of ordinary skill in the art based on this description.

In some embodiments, the shaft is decorated or designed to take the form of one or more accessories or attachments. Examples include, but are not limited to, a hat, a crown, a band, a bow, a flower, a scrunchie, a hair clip, a beanie, a bun, a horn, an antler, a fin, an antenna. Additional accessories that can be used to decorate the shaft can be readily envisioned by one of ordinary skill in the art based on this description.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed:

1. A head unit for displaying a facial expression, comprising:

an outer structure having a display opening;

an inner member rotatably mounted within the outer structure; and a plurality of panels rotatably mounted to the inner member, such that each of the plurality of panels is rotatably mounted in a corresponding window of the inner member, each of the plurality of panels including a first side and an opposite second side, and each of the first side and the second side of each of the plurality of panels has a different face or a facial expression;

wherein the inner member is rotatable about a first axis with respect to the outer structure to move one of the plurality of panels into registry with the display opening in the outer structure, wherein each of the plurality of panels is rotatable about a second axis within the corresponding window with respect to the inner member to display the first side or the second side through the display opening in the outer structure, wherein the first axis and the second axis are offset from one another, wherein the inner member includes a first shaft, and the outer structure comprises an aperture, and the first shaft extends through the aperture to rotatably connect the inner member to the outer structure, and wherein the device further comprises a first detent system associated with the inner member and the outer structure, the first detent system adapted to releasably hold the inner member in place with respect to the outer structure with one of the plurality of panels in registry with the display opening in the outer structure.

2. The head unit of claim 1, wherein the first axis and the second axis are parallel.

3. The head unit of claim 1, further comprising a knob located on the first shaft.

4. The head unit of claim 1, wherein each of the plurality of panels includes a second shaft rotatably connecting the respective panel to the inner member.

5. The head unit of claim 1, wherein each of the display panels includes a second detent system adapted to hold either the first side or the second side of the display panel in registry with the display opening in the outer structure.

6. The head unit of claim 5, wherein the second detent system comprises a spring-biased detent system.

7. The head unit of claim 1, wherein the second axis is a central axis with respect to each of the plurality of panels such that each of the plurality of panels rotates around the central axis.

8. The head unit of claim 1, wherein the first detent system is a spring-biased detent system comprising an elastic member and a pair of mating ramped structures, and wherein the elastic member is configured to bias a pair of ramped surfaces of said pair of mating ramped structures into engagement with one another.

9. The head unit of claim 8, wherein the elastic member is a spring.

10. A head unit for displaying a panel, comprising:

an outer structure having a display opening;

an inner member rotatably mounted within the outer structure; and a plurality of panels rotatably mounted to the inner member, such that each of the plurality of panels is rotatably mounted in a corresponding window of the inner member, each of the plurality of panels including a first side and an opposite second side, and each of the first side and the second side of each of the plurality of panels has a different face or a facial expression;

wherein the inner member is rotatable about a first axis with respect to the outer structure to move one of the plurality of panels into registry with the display opening, wherein each of the plurality of panels is rotatable about a second axis within the corresponding window of the inner member to display the first side or the second side through the display opening in the outer structure, and wherein the first axis and the second axis are offset from one another, wherein the inner member includes a first shaft, and the outer structure comprises an aperture, and the first shaft extends through the aperture to rotatably connect the inner member to the outer structure.

* * * * *